US009695776B2

(12) United States Patent
Muramoto et al.

(10) Patent No.: US 9,695,776 B2
(45) Date of Patent: Jul. 4, 2017

(54) CYLINDER BLOCK

(71) Applicant: Toyota Jidosha Kabushiki Kaisha, Toyota-shi, Aichi-ken (JP)

(72) Inventors: Ryohei Muramoto, Toyota (JP); Hiroyasu Koyama, Nagoya (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 137 days.

(21) Appl. No.: 14/864,131

(22) Filed: Sep. 24, 2015

(65) Prior Publication Data

US 2016/0090940 A1 Mar. 31, 2016

(30) Foreign Application Priority Data

Sep. 30, 2014 (JP) ..... 2014-202481

(51) Int. Cl.
*F02B 77/00* (2006.01)
*F02F 7/00* (2006.01)

(52) U.S. Cl.
CPC ..... *F02F 7/0012* (2013.01)

(58) Field of Classification Search
CPC ..... F02F 7/0012
USPC ..... 123/54.4–54.8, 196 R, 196 CP
See application file for complete search history.

(56) References Cited

U.S. PATENT DOCUMENTS 5,291,864 A * 3/1994 Suga ..... F02B 67/06 123/198 C
6,478,004 B1 * 11/2002 Deng ..... F02F 7/0012 123/195 C
2002/0066426 A1 * 6/2002 Takahashi ..... F01L 1/181 123/90.15
2005/0109290 A1 * 5/2005 Matsuda ..... F01M 1/06 123/41.38
2009/0241921 A1 * 10/2009 Ito ..... F01M 13/04 123/573
2013/0269636 A1 * 10/2013 Spix ..... F01M 13/04 123/41.86
2015/0233268 A1 * 8/2015 Ikeda ..... F01L 1/26 123/90.23

FOREIGN PATENT DOCUMENTS

JP 2011-158051 A 8/2011

* cited by examiner

*Primary Examiner* — Marguerite McMahon
(74) *Attorney, Agent, or Firm* — Dinsmore & Shohl LLP

(57) ABSTRACT

A cylinder block includes a first bank, a second bank, and a press-fitting portion. The first bank and the second bank are arranged in positions offset from each other in a cylinder arrangement direction. The press-fitting portion is provided straddling a first end surface of the first bank and a second end surface of the second bank. The press-fitting portion has a hole. The first end surface protrudes in a direction in which the press-fitting portion protrudes in the cylinder arrangement direction, with respect to the second end surface. A thickness of the press-fitting portion in a radial direction of the hole at a first portion that is connected to the first end surface is thinner than a thickness of the press-fitting portion in the radial direction of the hole at a second portion that is connected to the second end surface.

6 Claims, 2 Drawing Sheets

CYLINDER BLOCK

INCORPORATION BY REFERENCE

The disclosure of Japanese Patent Application No. 2014-202481 filed on Sep. 30, 2014 including the specification, drawings and abstract is incorporated herein by reference in its entirety.

BACKGROUND OF THE INVENTION

1. Field of the Invention

The invention relates to a cylinder block of an internal combustion engine.

2. Description of Related Art

A passage through which oil or coolant flows is provided in a cylinder block of an internal combustion engine. This kind of passage is able to be formed by assembling a core in a mold and molding a cylinder block, and then removing the core from a sand removing hole provided in the cylinder block. Aside from this kind of method that uses a core, there is also a method of forming a passage inside a cylinder block using a cutting tool such as a drill, after molding the cylinder block.

When forming a passage in the cylinder block by these methods, the sand removing hole or the hole resulting from cutting ends up remaining in the surface of the cylinder block. Japanese Patent Application Publication No. 2011-158051 (JP 2011-158051 A) describes technology for closing off such a hole by press-fitting a sealing member into a press-fitting portion where the hole is open. As a result, oil or coolant that flows through the passage is able to be inhibited from leaking out.

SUMMARY OF THE INVENTION

One type of engine, such as a V-type engine, has two banks of cylinders, i.e., a first bank and a second bank, arranged in a V-shape. A cylinder block of this kind of engine is molded such that the first bank and the second bank are positioned offset from each other in a cylinder arrangement direction, such that central axes of the cylinders provided in each bank do not intersect.

In this type of V-type engine or the like, a passage through which oil or coolant flows is often provided in a connecting portion between the first bank and the second bank. When the passage is formed in the connecting portion between the first bank and the second bank, a press-fitting portion into which a sealing member is press-fit is provided straddling end surfaces of both banks, on one end surface in the cylinder arrangement direction of both banks. Therefore, at least a portion of the press-fitting portion is connected to the first bank, and at least a portion of the rest of the press-fitting portion is connected to the second bank. As a result, there may be deviation in the rigidity of the press-fitting portion because the portion of the press-fitting portion that is on the first bank side is connected to the bank closer to an opening into which the sealing member is press-fit than the portion of the press-fitting portion that is on the second bank side, for example.

If deviation in the rigidity of the press-fitting portion occurs in this way, stress may concentrate at a portion where the rigidity is low when the sealing member is press-fit into the press-fitting portion. As a result, the low rigidity portion of the press-fitting portion may plastic deform.

The invention thus provides a cylinder block capable of inhibiting plastic deformation of the press-fitting portion.

One aspect of the invention relates to a cylinder block that includes a first bank, a second bank, and a press-fitting portion. The first bank and the second bank are arranged in a V-shape, and are arranged in positions offset from each other in a cylinder arrangement direction such that central axes of cylinders provided in the first bank do not intersect central axes of cylinders provided in the second bank. The press-fitting portion is provided straddling a first end surface of the first bank and a second end surface of the second bank on one side in the cylinder arrangement direction of both the first bank and the second bank. The press-fitting portion protrudes in the cylinder arrangement direction from the first end surface and the second end surface. Also, the press-fitting portion has a hole in a tip end of the press-fitting portion. The first end surface protrudes in a direction in which the press-fitting portion protrudes in the cylinder arrangement direction, with respect to the second end surface. A thickness of the press-fitting portion in a radial direction of the hole at a first portion that is connected to the first end surface is thinner than a thickness of the press-fitting portion in the radial direction of the hole at a second portion that is connected to the second end surface.

In an offset pair of banks, if the thickness of the press-fitting portion is made uniform along the entire periphery when the press-fitting portion is provided in a position straddling one end surface of both banks in the cylinder arrangement direction, the rigidity of a portion on the side with the bank where the distance from an opening into which a sealing member is press-fit to the end surface is short will be greater than the rigidity of the portion on the side with the bank where the distance to the end surface is long.

In contrast, with the structure described above, the thickness of the portion of the press-fitting portion that is connected to the end surface of the first bank where the distance from the opening into which the sealing member is press-fit to the end surface is short is thinner than the thickness of the portion of the press-fitting portion that is connected to the end surface of the second bank where the distance from the opening into which the sealing member is press-fit to the end surface is long, so deviation in the rigidity is able to be reduced by this difference in thickness.

Therefore, when the sealing member is press-fit into the press-fitting portion, stress is able to be inhibited from concentrating at a portion thereof, so plastic deformation of the press-fitting portion is able to be inhibited. In the cylinder block described above, the press-fitting portion may have a thick portion at the second portion, and the thickness of the thick portion may be thicker than the thickness of the first portion. According to this structure, the rigidity of the portion that is connected to the second bank is able to be increased, so deviation in the rigidity of the press-fitting portion is able to be reduced. However, if the thickness of the portion that is connected to the second bank is made thicker in this way, the weight of the press-fitting portion will increase, which may make the cylinder block heavier. Therefore, in the cylinder block described above, the press-fitting portion may have a thin portion at the first portion, and the thickness of the thin portion may be thinner than the thickness of the second portion. According to this structure, an increase in weight is able to be suppressed while reducing deviation in the press-fitting portion by reducing the rigidity of the portion that is connected to the first bank where the distance from the opening into which the sealing member is press-fit to the end surface is short.

In the cylinder block described above, the press-fitting portion may have a cylindrical shape. Also, the first portion may be a first half portion positioned on a first bank side, and the second portion may be a second half portion positioned on a second bank side, and the thickness of the first half portion may be thinner than the thickness of the second half portion.

According to this structure, the rigidity of the half portion positioned on the first bank side where the distance from the opening into which the sealing member is press-fit to the end surface is short is able to be reduced, compared to when the thickness of a portion thereof is made thinner. Therefore, when the degree of offset in the cylinder arrangement direction of both banks is large, and the thickness of the press-fitting portion is made uniform along the entire periphery, even if a deviation between the rigidity of the portion on the first bank side where the distance from the opening into which the sealing member is press-fit to the end surface is short and the rigidity of the portion on the second bank side where the distance from the opening into which the sealing member is press-fit to the end surface is long is large, this deviation in rigidity is able to be reduced by employing the press-fitting portion of the structure described above. As a result, stress is able to be inhibited from accumulating at a portion of the press-fitting portion, and consequently, plastic deformation of the press-fitting portion is able to be inhibited.

In the cylinder block described above, the thickness of the first portion and the thickness of the second portion are set such that a rigidity of the press-fitting portion is uniform along an entire periphery of the press-fitting portion.

According to this structure, when the sealing member is press-fit into the press-fitting portion, stress will act uniformly along the entire periphery, so excessive stress is inhibiting from acting on a portion of the press-fitting portion when the sealing member is press-fit. As a result, plastic deformation of the press-fitting portion is able to be further inhibited.

The cylinder block described above may also include a passage, and the press-fitting portion may form an end portion of the passage, on the one side in the cylinder arrangement direction.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
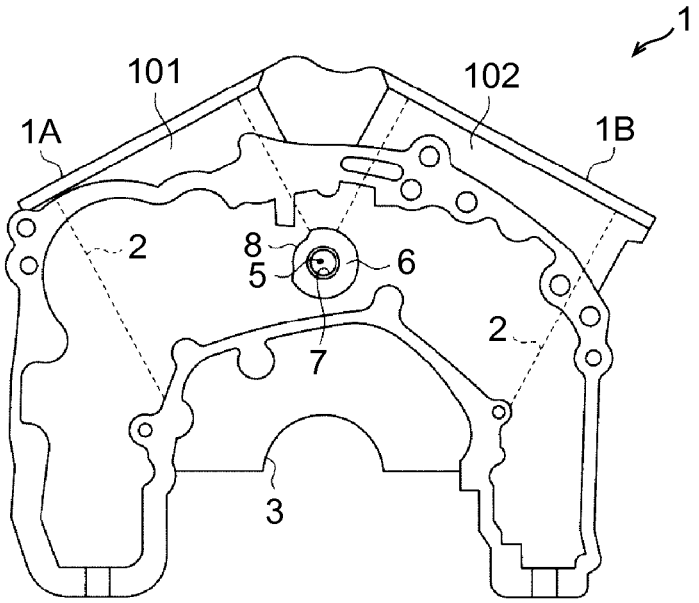
FIG. 1 is a side view of a cylinder block according to one example embodiment of the invention.
Figure 2:
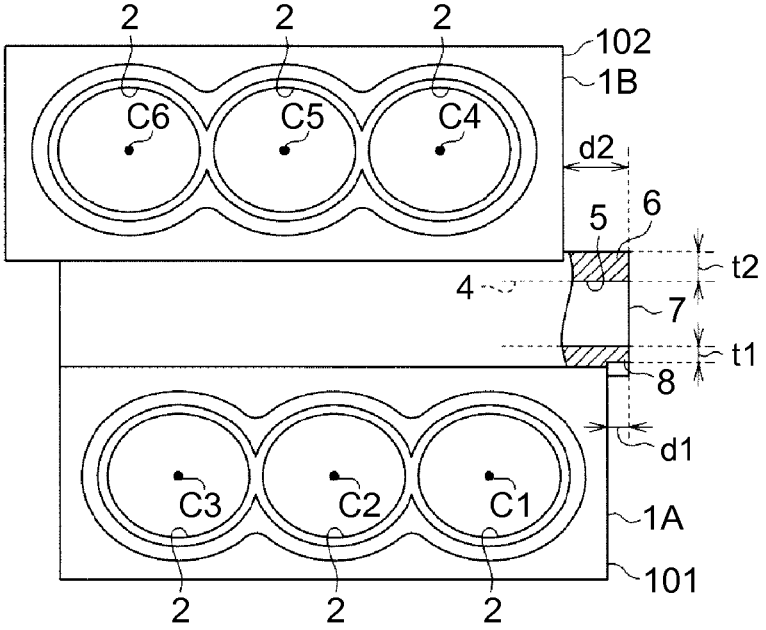
FIG. 2 is a view showing a frame format of the positional relationship between banks that are provided offset, of the cylinder block according to the example embodiment.
Figure 3:
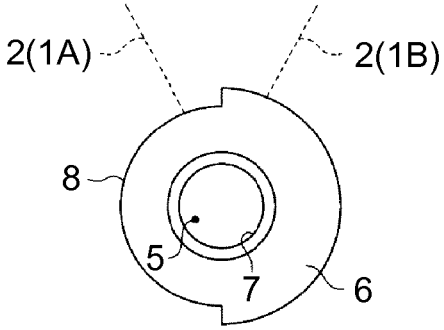
FIG. 3 is an enlarged view of a press-fitting portion provided on the cylinder block according to a modified example of the example embodiment.

An example embodiment of the cylinder block of the invention will now be described with reference to FIGS. 1 to 3. In this example embodiment, a cylinder block of a V-6 engine will be described as an example. As shown in FIGS. 1 and 2, two banks 1A and 1B arranged in a V-shape are provided in a cylinder block 1. In the description below, the bank positioned on the left side in FIG. 1 (on the lower side in FIG. 2) is the first bank 1A, and the bank positioned on the right side in FIG. 1 (on the upper side in FIG. 2) is the second bank 1B. Three cylinders 2 are provided in each of the banks 1A and 1B.

A piston is housed so as to be able to move in a reciprocating manner in each cylinder 2. A semicircular journal portion 3 is provided in the center on a lower surface of the cylinder block 1. A crankshaft is rotatably supported by the journal portion 3 and a crank cap.

As shown in FIG. 2, the banks 1A and 1B of the cylinder block 1 are arranged in offset positions such that the position in a cylinder arrangement direction (a left-right direction in FIG. 2) of centers C1 to C3 of the cylinders 2 provided in the first bank 1A does not overlap with the position in the cylinder arrangement direction of centers C4 to C6 of the cylinders 2 provided in the second bank 1B. That is, in the cylinder block 1, the banks 1A and 1B are arranged in offset positions in the cylinder arrangement direction (the depth direction of the paper on which FIG. 1 is drawn, and the left-right direction in FIG. 2) of the cylinder block 1, such that the central axes of the cylinders 2 provided in the banks 1A and 1B do not intersect.

As shown in FIGS. 1 and 2, a generally cylindrical press-fitting portion 6 that protrudes in the cylinder arrangement direction is provided straddling both banks 1A and 1B, on one end surface 101 and 102 in the cylinder arrangement direction of both of the banks 1A and 1B. Therefore, the left half of the press-fitting portion 6 in FIG. 1 is positioned on the first bank 1A side, and the right half of the press-fitting portion 6 in FIG. 1 is positioned on the second bank 1B side. That is, the half portion of the press-fitting portion 6 that is positioned on the first bank 1A side is connected to the end surface 101 of the first bank 1A, and the remaining half portion of the press-fitting portion 6 is connected to the end surface 102 of the second bank 1B.

A press-fitting hole 5 is open in a tip end of the press-fitting portion 6. This press-fitting hole 5 is communicated with a passage 4 provided in a connecting portion between the first bank 1A and the second bank 1B. Oil flows through this passage 4. That is, the press-fitting portion 6 forms an end portion of the passage 4, on one side in the cylinder arrangement direction.

The first bank 1A and the second bank 1B are arranged offset as described above. In this example embodiment, the end surface 101 of the first bank 1A protrudes in the direction in which the press-fitting portion 6 protrudes in the cylinder arrangement direction, with respect to the end surface 102 of the second bank 1B. Therefore, the portion of the press-fitting portion 6 that is on the first bank 1A side is connected to the bank closer to an opening 7 of the press-fitting hole 5 into which a sealing member is press-fit than the portion of the press-fitting portion 6 that is on the second bank 1B side. In other words, a distance d1 from the opening 7 of the press-fitting portion 6 into which the sealing member is press-fit to the end surface 101 of the first bank 1A is shorter than a distance d2 from the opening 7 of the press-fitting portion 6 to the end surface 102 of the second bank 1B (i.e., $d1<d2$).

Also, as shown in FIG. 1, a thin portion 8 that is thinner in a radial direction of the press-fitting hole 5 than the half portion positioned on the second bank 1B side, is formed on a portion of the half portion of the press-fitting portion 6 that is positioned on the first bank 1A side. As a result, a thickness t1 of the portion of the press-fitting portion 6 that is on the first bank 1A side is thinner than a thickness t2 in the radial direction of the press-fitting hole 5 of the portion of the press-fitting portion 6 that is on the second bank 1B side, as shown in FIG. 2. The thickness t1 of the portion on the first bank 1A side and the thickness t2 of the portion on the second bank 1B side are set such that the rigidity of the press-fitting portion 6 is uniform along the entire periphery.

Next, the operation of the cylinder block 1 according to the example embodiment will be described. If the thickness of the press-fitting portion is uniform along the entire periphery when the press-fitting portion is provided in a position straddling both end surfaces of the pair of offset banks, the rigidity of the portion on the side with the bank where the distance from the opening into which the sealing member is press-fit to the end surface is short will be higher than the rigidity of the portion on the side with the bank where the distance to the end surface is long.

In contrast, in this example embodiment, the thin portion 8 is formed on a portion of the half portion on the first bank 1A side where the distance from the opening 7 into which the sealing member is press-fit to the end surface 101 is short, and the thickness t1 of this portion is thinner than the thickness t2 of the half portion positioned on the second bank 1B side where the distance from the opening 7 into which the sealing member is press-fit to the end surface 102 is long. As a result, deviation in the rigidity is reduced by this difference in thickness. Therefore, stress generated when the sealing member is press-fit into the press-fitting portion 6 is inhibited from concentrating at a portion of the press-fitting portion 6.

Because the thin portion 8 that is thinner than the half portion of the press-fitting portion 6 that is connected to the end surface 102 of the second bank 1B is provided on the half portion of the press-fitting portion 6 that is connected to the end surface 101 of the first bank 1A, the rigidity of the portion of the press-fitting hole 5 that is connected to the first bank 1A where the distance from the opening 7 to the end surface 101 is short is reduced, so deviation in the rigidity of the press-fitting portion 6 is reduced. Also, the thickness of the overall press-fitting portion 6 is able to be thinner, thus enabling an increase in weight to be suppressed, compared to when a portion that is thicker than the portion connected to the end surface 101 of the first bank 1A is provided on the portion connected to the end surface 102 of the second bank 1B.

The thickness t1 of the portion on the first bank 1A side and the thickness t2 of the portion on the second bank 1B side are set such that the rigidity of the press-fitting portion 6 is uniform along the entire periphery, so excessive stress is able to be inhibited from acting on a portion of the press-fitting portion when the sealing member is press-fit into the press-fitting portion 6.

The example embodiment described above is able to achieve the effects below. (1) The thickness t1 of the portion of the press-fitting portion 6 that is connected to the end surface 101 of the first bank 1A is thinner than the thickness t2 of the portion of the press-fitting portion 6 that is connected to the end surface 102 of the second bank 1B. Therefore, a deviation in the rigidity is able to be reduced by this difference in thickness, so stress is able to be inhibited from concentrating at a portion of the press-fitting portion 6 when the sealing member is press-fit into the press-fitting portion 6. Consequently, plastic deformation of the press-fitting portion 6 is able to be inhibited.

(2) The thin portion 8 that is thinner than the portion that is connected to the end surface 102 of the second bank 1B is provided on a portion of the half portion of the press-fitting portion 6 that is connected to the end surface 101 of the first bank 1A, and the thickness t1 of this portion is thinner than the thickness t2 of the half portion that is connected to the end surface 102 of the second bank 1B. Therefore, an increase in the weight of the press-fitting portion 6 is able to be suppressed, while reducing deviation in the rigidity of the press-fitting portion 6 by reducing the rigidity of the portion that is connected to the end surface 101 of the first bank 1A where the distance from the opening 7 of the press-fitting hole 5 to the end surface 101 is short.

(3) The thickness t1 of the portion on the first bank 1A side and the thickness t2 of the portion on the second bank 1B side are set such that the rigidity of the press-fitting portion 6 will be uniform along the entire periphery, so excessive stress is inhibited from acting on a portion of the press-fitting portion 6 when the sealing member is press-fit. As a result, plastic deformation of the press-fitting portion 6 is able to be further inhibited.

The example embodiment described above may be modified as described below. In the example embodiment described above, the thickness t1 of the portion on the first bank 1A side and the thickness t2 of the portion on the second bank 1B side are set such that the rigidity of the press-fitting portion 6 will be uniform along the entire periphery, but the manner in which thicknesses t1 and t2 are set may be changed. That is, if the thickness t1 of the portion on the first bank 1A side and the thickness t2 of the portion on the second bank 1B side are set such that deviation in the rigidity of the press-fitting portion 6 is reduced, compared to when the thickness of the press-fitting portion 6 is uniform along the entire periphery, the effects described in (1) and (2) above are able to be obtained.

In the example embodiment described above, the thin portion 8 is provided on a portion of the portion of the press-fitting portion 6 that is positioned on the first bank 1A side. Instead of this kind of structure, all of the half portion of the press-fitting portion 6 that is positioned on the first bank 1A side, i.e., the entire left half of the press-fitting portion 6, may be the thin portion 8, as shown in FIG. 3. With this structure, the rigidity of the half portion that is positioned on the first bank 1A side where the distance from the opening 7 of the press-fitting hole 5 to the end surface 101 is short is able to be reduced compared to when the thickness of only a portion is made thin. Therefore, when the degree of offset in the cylinder arrangement direction of both banks 1A and 1B is large, and the thickness of the press-fitting portion 6 is made uniform along the entire periphery, even if a deviation between the rigidity of the portion on the first bank 1A side and the rigidity of the portion on the second bank 1B side is large, this deviation in rigidity is able to be reduced. Thus, with this kind of structure as well, stress is able to be inhibited from accumulating at a portion of the press-fitting portion 6, so effects similar to those described in (1) and (2) above are able to be obtained.

Figure 4:
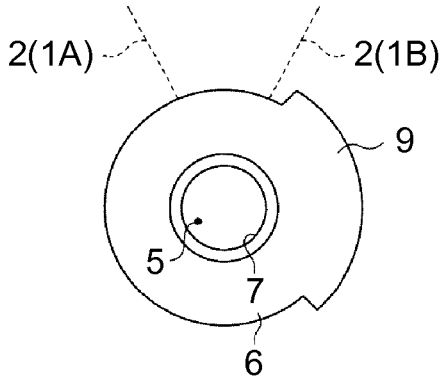
FIG. 4 is an enlarged view of a press-fitting portion provided on the cylinder block according to another modified example of the example embodiment.

In the example embodiment described above, the thickness t1 of the portion positioned on the first bank 1A side is made thinner than the thickness t2 of the portion positioned on the second bank 1B side by providing the thin portion 8 on the portion of the press-fitting portion 6 that is positioned on the first bank 1A side. Instead of this kind of structure, the thickness of the portion positioned on the first bank 1A side may be made thinner than the thickness of the portion positioned on the second bank 1B side by providing a thick portion 9 that is thicker than the portion positioned on the first bank 1A side, on the portion of the press-fitting portion 6 that is positioned on the second bank 1B side, as shown in FIG. 4. With this kind of structure as well, a deviation in the rigidity of the press-fitting portion 6 is able to be reduced by this difference in thickness of the press-fitting portion 6, similar to the example embodiment described above, so the effects described in (1) above are able to be obtained.

In the example embodiment described above, a structure in which the end surface 101 of the first bank 1A positioned on the left side in FIG. 1 protrudes in the direction in which the press-fitting portion 6 protrudes in the cylinder arrangement direction, with respect to the end surface 102 of the second bank 1B positioned on the right side in FIG. 1 is described as an example, but the structure of the cylinder block is not limited to this. That is, the end surface of the bank positioned on the right side in FIG. 1 may protrude in the direction in which the press-fitting portion 6 protrudes in the cylinder arrangement direction, with respect to the end surface of the bank positioned on the left side in FIG. 1. In this case, the thickness of the portion of the press-fitting portion 6 that is connected to the end surface of the bank positioned on the right side need simply be made thinner than the thickness of the portion that is connected to the end surface of the second bank positioned on the left side. With this structure, the bank positioned on the right side corresponds to the first bank, and the bank positioned on the left side corresponds to the second bank. With this kind of structure as well, effects similar to those described in (1) above are able to be obtained.

In the example embodiment described above, a cylinder block of a V-type engine is described as an example, but a similar structure may also be applied to a cylinder block of an engine that has two or more pairs of banks arranged in V-shapes, such as a W-type engine, for example. A cylinder block of a W-type engine has four banks that are divided into two sets of two, with the two banks in each set being arranged in a V-shape similar to the V-type engine described above. In this kind of engine as well, in each set, the two banks are arranged with one bank being in a position offset from the other bank in the cylinder arrangement direction, such that the central axes of the cylinders of the two banks do not intersect. Therefore, when a press-fitting portion is provided straddling the end surfaces of both banks, on one end surface in the cylinder arrangement direction of both sets of banks, effects similar to those described in (1) above can be obtained by applying a structure similar to that described in the example embodiment above to the press-fitting portion. With a cylinder block of a W-type engine, two sets of two banks (i.e., two pairs of banks) are provided, but a structure similar to that described in the example embodiment above need only be applied to a press-fitting portion provided on at least one of the sets.

In the example embodiment described above, a V-6 engine is described as an example, but the number of cylinders may be changed as appropriate. With a W-type engine, the number of cylinders may be changed to 8, 12, or 16 or the like.

What is claimed is:

1. A cylinder block comprising:

a first bank;

a second bank, the first bank and the second bank being arranged in a V-shape, the first bank and the second bank being arranged in positions offset from each other in a cylinder arrangement direction such that central axes of cylinders provided in the first bank do not intersect central axes of cylinders provided in the second bank;

a press-fitting portion that is provided straddling a first end surface of the first bank and a second end surface of the second bank on one side in the cylinder arrangement direction of both the first bank and the second bank, the press-fitting portion protruding in the cylinder arrangement direction from the first end surface and the second end surface, and the press-fitting portion having a hole in a tip end of the press-fitting portion, wherein the first end surface protrudes in a direction in which the press-fitting portion protrudes in the cylinder arrangement direction, with respect to the second end surface; and a thickness of the press-fitting portion in a radial direction of the hole at a first portion that is connected to the first end surface is thinner than a thickness of the press-fitting portion in the radial direction of the hole at a second portion that is connected to the second end surface.

2. The cylinder block according to claim 1, wherein the press-fitting portion has a thick portion at the second portion, the thickness of the thick portion being thicker than the thickness of the first portion.

3. The cylinder block according to claim 1, wherein the press-fitting portion has a thin portion at the first portion, the thickness of the thin portion being thinner than the thickness of the second portion.

4. The cylinder block according to claim 1, wherein the press-fitting portion has a cylindrical shape;

the first portion is a first half portion positioned on a first bank side, and the second portion is a second half portion positioned on a second bank side; and the thickness of the first half portion is thinner than the thickness of the second half portion.

5. The cylinder block according to claim 1, wherein the thickness of the first portion and the thickness of the second portion are set such that a rigidity of the press-fitting portion is uniform along an entire periphery of the press-fitting portion.

6. The cylinder block according to claim 1, further comprising:

a passage, wherein the press-fitting portion forms an end portion of the passage, on the one side in the cylinder arrangement direction.

* * * * *